United States Patent [19]

Brabant

[11] 4,449,270

[45] May 22, 1984

[54] HANGING DEVICE FOR CURTAIN STRAPS OUT OF RESILIENT PLASTIC MATERIAL FOR CLOSING BUILDING OPENINGS

[76] Inventor: Henri Brabant, La Cote, 43220 Dunieres, France

[21] Appl. No.: 309,892

[22] PCT Filed: Feb. 6, 1981

[86] PCT No.: PCT/FR81/00014

§ 371 Date: Oct. 7, 1981

§ 102(e) Date: Oct. 7, 1981

[30] Foreign Application Priority Data

Feb. 8, 1980 [FR] France ..... 80 02832

[51] Int. Cl.[3] ..... A47H 1/04

[52] U.S. Cl. ..... 16/87.4 R; 16/95 R; 16/96 R; 160/332; 211/45; 281/47

[58] Field of Search ..... 16/87.2, 87.4 R, 87.4 W, 16/94 R, 94 D, 95 R, 95 W, 95 D, 95 DW, 96 R, 96 D, 96 L; 160/332, 184; 248/307; 211/45; 281/45, 46, 47; 402/501

[56] References Cited

U.S. PATENT DOCUMENTS

| | | | |
|---|---|---|---|
| 762,873 | 6/1904 | Bingham | 16/87.4 R |
| 1,835,381 | 12/1931 | Collantes . | |
| 2,277,549 | 3/1942 | Jervis . | |
| 2,834,980 | 5/1958 | Fridolph | 16/87.4 R X |
| 4,033,396 | 7/1977 | Thomasset | 160/332 |
| 4,335,777 | 6/1982 | Simon | 160/184 |

FOREIGN PATENT DOCUMENTS

| | | |
|---|---|---|
| 0012704 | 6/1980 | European Pat. Off. . |
| 1458993 | 11/1966 | France . |
| 90254 | 11/1967 | France . |
| 2175607 | 10/1973 | France . |
| 2324842 | 4/1977 | France . |
| 495489 | 10/1970 | Switzerland . |
| 581774 | 11/1976 | Switzerland . |

*Primary Examiner*—Fred Silverberg

*Attorney, Agent, or Firm*—Cushman, Darby & Cushman

[57] ABSTRACT

The hanging device comprises rigid strap hanging members to which the straps are secured, each formed at its upper part with transversally spaced hook-shaped openings to be hooked on transversal hooking members identically spaced arranged within a rigid suspending hollow girder having the shape of an inverted U.

2 Claims, 8 Drawing Figures

HANGING DEVICE FOR CURTAIN STRAPS OUT OF RESILIENT PLASTIC MATERIAL FOR CLOSING BUILDING OPENINGS

BACKGROUND OF THE INVENTION

1. Field of the invention

The present invention relates to the devices for suspending or hanging resilient bands or straps out of a possibly translucent plastic material or the like, which are widely utilized for closing doors of industrial premises or for partitioning, insulating or hiding quarters inside or outside a building by a curtain or screen made of several depending straps.

2. Description of the prior art

In such a kind of closure means, the straps are usually suspended by the upper end and overlap laterally at least partially so as to form a resilient distortable restorable curtain which is easily traversable by persons, vehicles or loads while insuring a convenient sealing to the draughts and the thermal losses. Generally, the straps are each rigidly suspended by means of a hanging device comprised by two assembled shells in gripping engagement on one hand with the upper end of the resilient strap and on the other hand with a hanging metal section having the shape or .

When superstructures of vehicles or loads traversing the screen pass adjacent the hanging device, said latter cannot follow the displacement of the straps which accordingly are submitted at the upper portion thereof to heavy bending stresses causing rapidly the straps to be worn or torn.

In order to obviate such drawbacks, it has been proposed to suspend the resilient straps out of plastic material by means of a hanging device comprised by two shells which are rigidly connected at the lower part thereof to the upper part of the strap and which are pivotally mounted at the upper part thereof around a rectilinear rod or tube serving as a stready hanging device extending longitudinally in the plane of the door under the ceiling or under a lintal. When a load traverses the strap curtain and passes very close to the strap hanging devices, the shells to which the straps are secured may be deflected angularly without causing locally injuring bending of the straps. Practically, the pivoting mounting of the shells on the tube or the rod is a direct mounting "iron/iron" without a specific machining of the parts and without utilization of bearings or bushings even if the different elements have been previously subject to a corrosion-proof treatment such as electroplating or galvanizing. By reason of the wear, the protective treatment progressively disappears and in corrosive or moist atmosphere, more particularly if the curtain is installed outside a building, stain appear quickly and progressively hinders the pivoting movement of the shells. On the other hand, in order to allow convenient pivoting displacement of the shells on the suspension tube or rod, said tube cannot be mounted directly onto the lintal or the ceiling and has to be set slightly apart therefrom whereby leaving a space between the tube and the ceiling or the lintal in an arrangement which is detrimental to a convenient air-sealing by the curtain.

In order to partially obviate such drawbacks, it has been further proposed a strap hanging device comprising, on one hand, a hanging hollow U-shaped beam provided with oscillating apertures extending transversally to its longitudinal axis and, on the other hand, hanging members the lower portion of which is secured rigidly to the upper portion of a resilient strap out of plastic material and the upper portion of which has a substantially T-shaped outwardly extending small hook. Said T-shaped small hooks at the upper portion of the hanging members are engaged within the wider parts of the oscillating apertures formed in the U-shaped beam so as to come to a freely bearing position on the bottom of the beam where the width of the apertures is reduced.

A drawback of such a system resides in the poor sealing at the upper part of the resilient curtain resulting, on one hand, from the apertures formed in the U-shaped beam and separated one from each other from a distance of about 5 to 10 cm, and, on the other hand, from the clearing distance between the upper part of the strap hanging members forming the small T-shaped suspending hooks and the bottom portion of the U-shaped beam.

Another drawback resides in the fact that the apertures formed in the U-shaped beam reduce the mechanical strength of the beam with accordingly the requirement of necessarily increasing the number of mounting means for securing the beam to the ceiling or the lintal.

It has also been proposed hanging devices including a two-part hanging beam consisting of a C-shaped part and a cover part. The horizontally extending upper flange or the vertically extending web of the C-shaped part serves to mount the assembly to the lintal or ceiling when the lower flange of the C-shaped part is is formed with parallel slots in a comb-like configuration for hooking the strap hanging members formed with hooking holes. The second part serves as a cover for the C-shaped part and is mounted thereon when the strap hanging members have been installed on the comb-like lower flange of the C-shaped part to prevent a withdrawal of said hanging members when the straps are displaced or spread as the result of passages of vehicles, persons or loads through the strap curtain.

However, with such an arrangement, when a load traverses the strap curtain, the forces exerted by the displaced, e.g. pushed straps onto the hanging members may cause same to unfasten the cover part which is usually simply spring engaged therewith.

OBJECT OF THE INVENTION

There is an object of the invention to provide an improved hanging device for closure curtain straps which is reliable, shows improved sealing properties, is of reduced manufacturing costs and permits easy mounting as well as removal of the straps while allowing several mounting modes for overlapping laterally the straps.

BRIEF SUMMARY OF THE INVENTION

In order to meet this object and others, the hanging device of the invention comprises rigid hanging members to the lower portion of each of which is secured the upper end of a strap out of a resilient plastic material, and the upper portion of each of which is formed with cut openings defining spaced hooks adapted to cooperate in engagement with transversal hooking members each having a width less than the width of the openings and extending transversally inside a rigid hanging metal girder in the form of an inverted U adapted to be secured to the upper part of the opening or the door to be closed.

Said transversal hooking elements in the girder extend parallel and equidistant one from each other and are introduced in the upper part of the hook-shaped openings of the hanging member, each aperture defining advantageously two opposite hook portions, so as to come into bearing hanging position onto the bottom of said openings to quickly insure separate hanging of the different straps, two straps side by side or in a partial or total overlapping relationship, while preventing any undue withdrawal, e.g. unhooking of the hanging members when a load traverses the curtain formed by said suspended straps. The straps may oscillate independently one from each other on the transversally extending members in the metal girder, whereby greatly diminishing the stresses in the plastic straps and facilitating the passing of a load through the curtain.

According to a preferred feature of the invention, the transversal hooking members installed in the metal girder in the shape of an inverted U substantially extend in a plane at a level slightly higher than the base portion of the girder so as to ensure convenient sealing at the level of the hook-shaped openings formed in the hanging members hooked to said hooking transversal members and which are thus at least partially received within the internal space of the girder.

The single or double hook-shaped openings open at the upper edge of each strap hanging member and comprises there a passage portion directed downwardly prolongated by a portion extending laterally towards the left and/or towards the right while forming a loop or an angle each terminated by a bottom abutment portion extending upwardly towards the upper end of the hanging member along a reduced distance so as not to reach said upper edge of the hanging member to thereby define a bearing recess preventing only as a result of the own weight of the strap any undue unhooking of the hanging member.

Preferably, the hollow girder having the shape of an inverted U to be secured to the upper part of the opening to be closed by any convenient means, comprises lateral downwardly extending flanges the end of each of which is bent inwardly and extends slightly upwardly inside the inner space in the girder while leaving transversally therebetween a free space for passing and hooking the strap hanging members, the transversal hook support members being comprised by at least a disposable rod bent to form a planar greek key-pattern, e.g. with successive opposite alternate U's , two adjacent U's top to bottom, in bearing contact onto the parallel edges of the inwardly curled end portions of the flanges of the girder defining therebetween a transversal width lesser than the width of the inner space within the girder.

According to another feature of the invention, the hollow girder in the form of an inverted U has straight lateral downwardly extending flanges onto which are secured substantially V-shaped parallel rods extending in parallel planes perpendicular to the longitudinal axis of the hollow girder, each V-shaped member being supported in the girder by its legs which have a spread corresponding substantially to the inner transverse width of the hollow girder and are secured, e.g. soldered to the inner faces of the flanges of the girder. The height of the rounded V formed by each rod is lower than the total height of the hollow girder. Such an arrangement permits a greater angular displacement of the straps.

According to another feature of the invention, straight rods having substantially the same length may be secured in the girder while transversing both flanges of the girder so as to extend in a plane at a level slightly higher than the plane of the lower end of the flanges of the girder, whereby it is here required to have aligned holes formed within the flanges of the girder and stopping means for securing the rods in said holes.

Other objects and advantages will appear from the ensuing description and drawings in which:

DETAILED DESCRIPTION OF THE DRAWINGS

Figure 1:
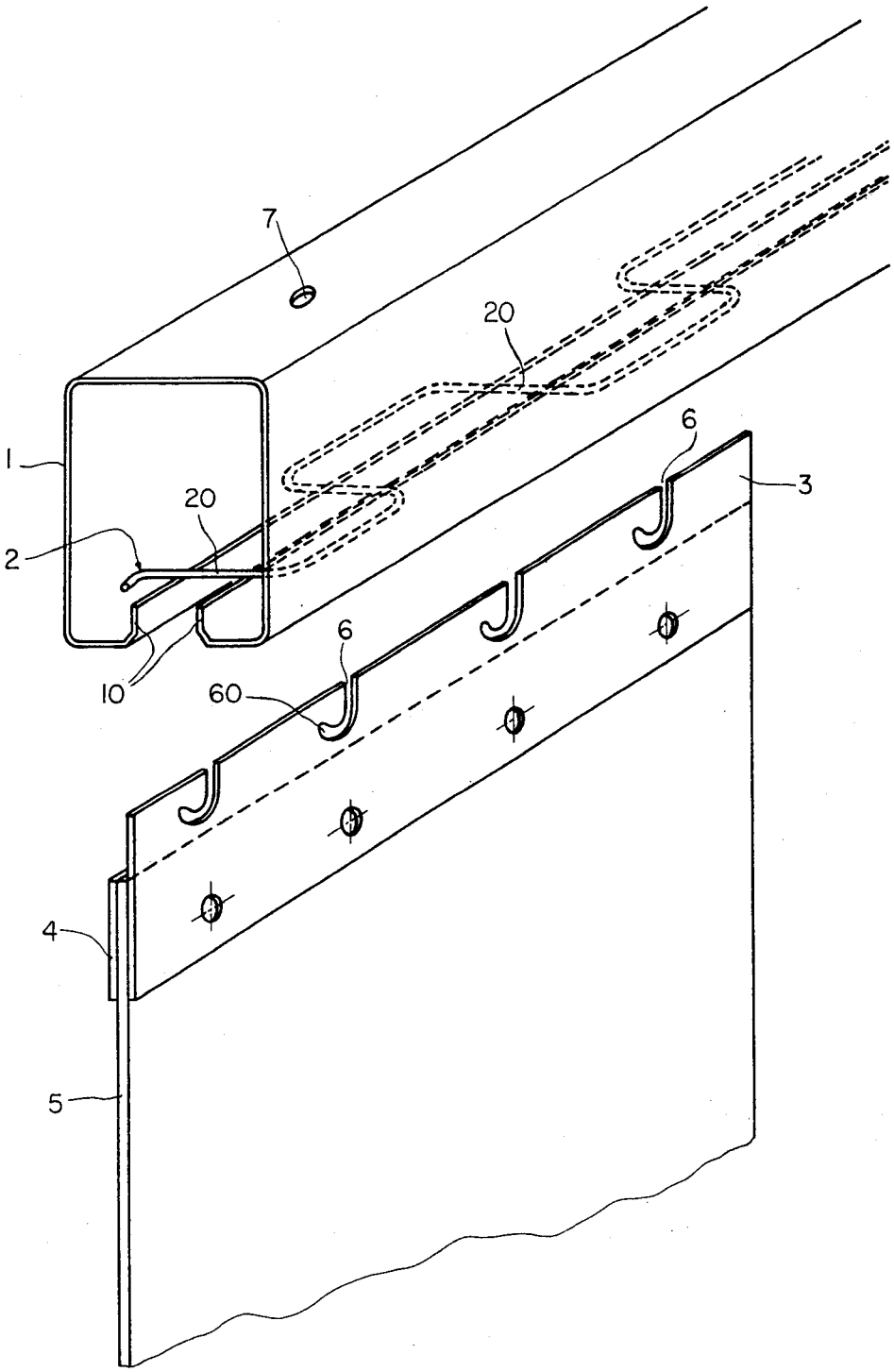
FIG. 1 is an exploded perspective view of a first embodiment of the device of the invention.

Referring now to the drawings, the strap hanging device of the invention comprises a hollow elongated hanging girder 1 having the shape of an inverted U with the end of its downwardly extending lateral flanges turned up inside the internal space of the girder. The girder is adapted to be secured by any convenient means to the upper portion of an opening to be closed by the curtain straps. In the embodiments of FIGS. 1 to 6, there is arranged within the girder a continuous rod shaped in the form of a greek key-pattern, e.g. with successive inverted U's, two adjacent u's top to bottom, the overall transverse width of the shaped hanging rod being slightly lesser than the internal width of the girder 1. The pitch l of the U corresponds to the pitch of the openings 6 in the hanging members 3 for suspending the straps 5. The shaped hooking rod 2 is in bearing contact on the inner edges of the inwardly folded ends of the flanges of the girder 1 along the wings of the different U's which constitute the transversal hanging members 20 to be received within the openings 6. The girder 1 is formed for instance at its upper part with holes 7 for its mounting on an upper horizontal plane of a building, generally at the upper part of the opening to be closed, or of the vertical plane to be closed, partitioned or insulated.

The upper end of each resilient strap 5 is secured to a plate hanging member 3 made out of metal or any convenient strong material. Mounting of a strap 5 to said hanging member 3 is achieved by any convenient means, such as bolts, rivets or crimping, a counter-plate 4 being advantageously utilized to reinforce said mounting.

The upper portion of the hanging member 3 is formed with openings or recesses 6 which are cut to define laterally from a substantially upwardly extending portion one hook 60 (FIGS. 1 and 5) or two hooks 60,60' (FIG. 2) extending symmetrically in the opposite lateral directions.

Figure 4:
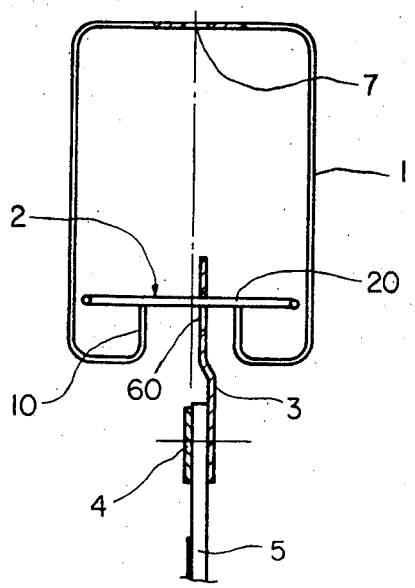
FIG. 4 is a transverse cross section of the device of FIGS. 1 to 3.
Figure 3:
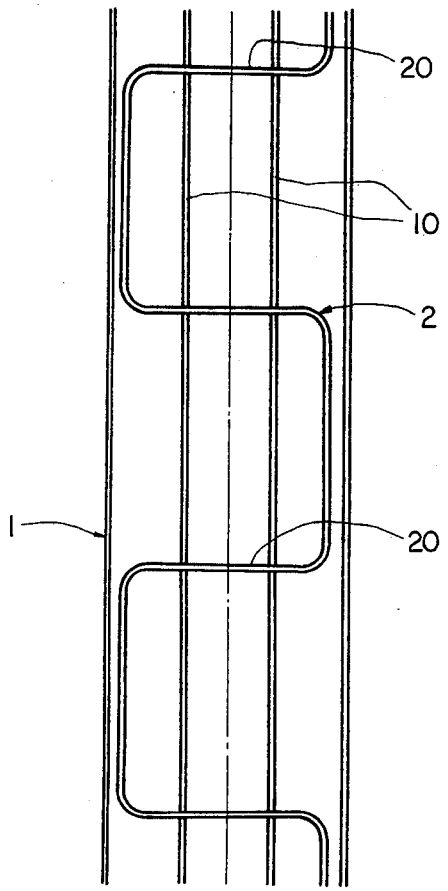
FIG. 3 is a top view showing the arrangement of the greek key-patterned hooking rod in the girder.
Figure 5:
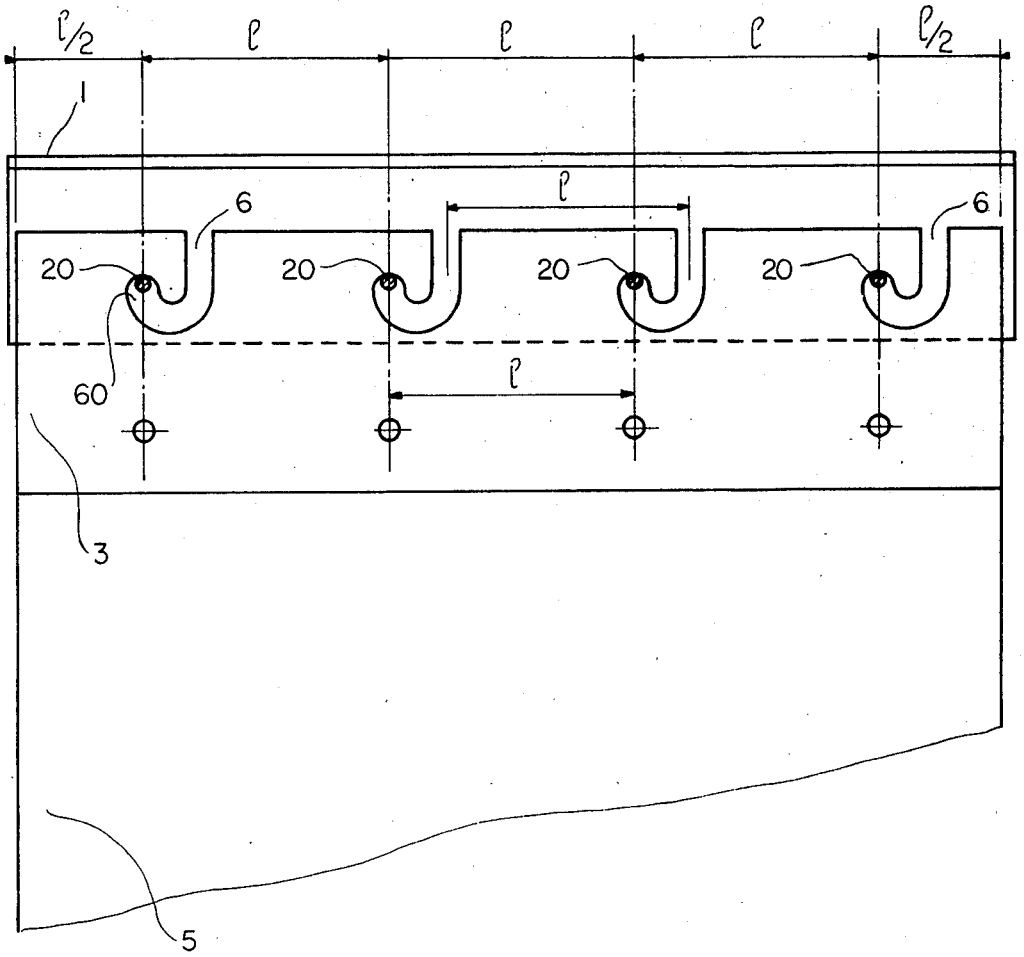
FIG. 5 is a longitudinal cross section of the embodiment of FIG. 1 illustrating the strap hanging member in hooked position in the girder.

As best seen in FIG. 4, the hanging member 2 with its successive coplanar inverted U's is in bearing contact onto the also coplanar edges of the inwardly folded ends 10 of the flanges in the girder 1. A strap hanging member 3 hooked on the suspending member 2 may freely oscillate laterally, whereby diminishing the stresses in the strap when a displacing force is applied to the strap 5. As best seen in FIG. 5, the transversal hanging members 20 of the hooking member 2 extend in a plane at a level slightly higher than the plane of the lower ends of the flanges of the girder 1, whereby the strap hanging members 3 may be hooked thereto without having the openings 6 and the hook-shaped prolongating recesses thereof 60,60' exhibited below the girder 1, to thereby insure the hereinforth mentioned convenient sealing.

Figure 6:
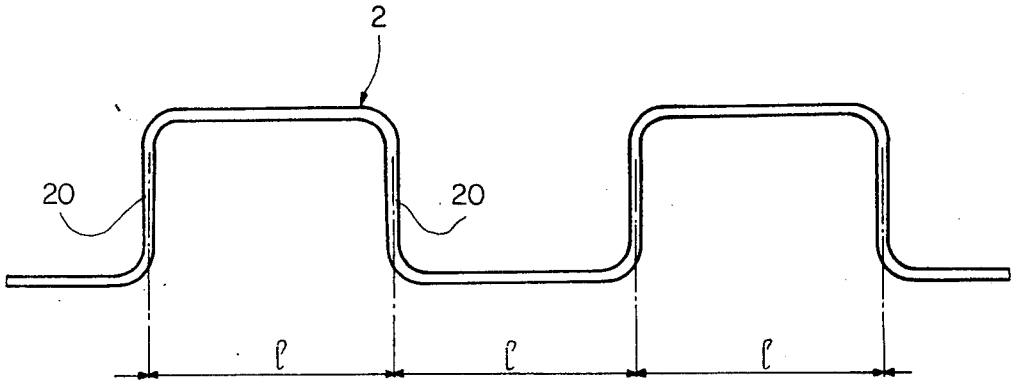
FIG. 6 is a separate view of the shaped hooking rod.

FIG. 6 depicts the transversal hanging members 20 for the hooks 60,60' formed by the shaped rod 2 bent to define successive top-to-bottom adjacent coplanar U's. The transversal hanging members may be formed by bridge portions of a reduced width interconnecting two longitudinally extending lateral strips, as in a ladder. Such a structure is obtained for instance by punching an elongated metal blank and is introduced from one front end of the girder therein as the shaped rod 2, so as to bear upon the edges of the inwardly folded ends 10 of the girder flanges.

Figure 8:
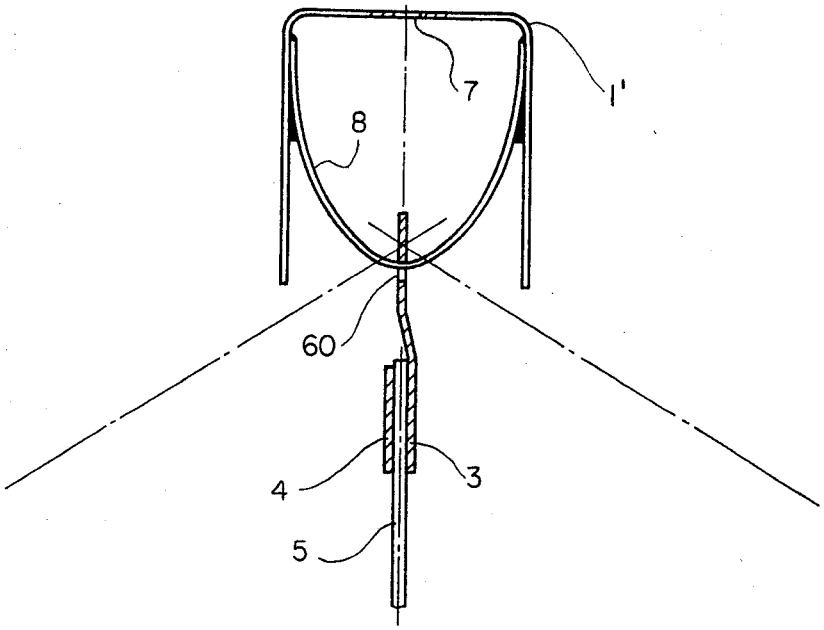
FIGS. 7 and 8 illustrate a further embodiment of the strap hanging device of the invention.
Figure 7:
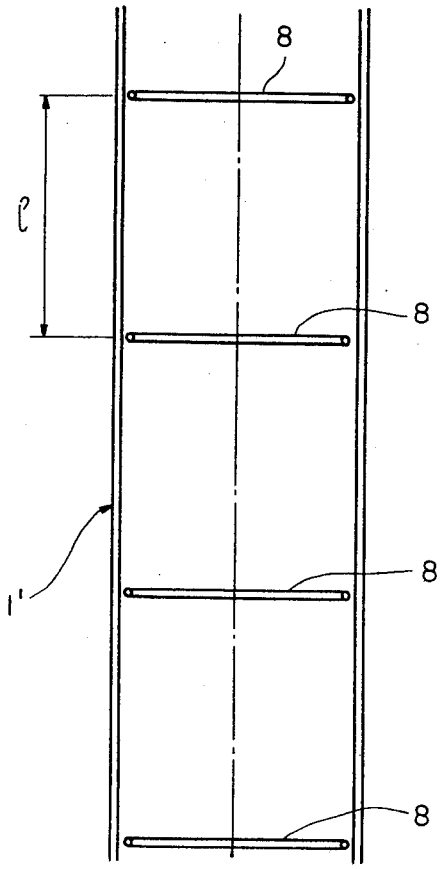

In the embodiment of FIGS. 7 and 8, the girder 1' has lateral straight flanges devoid of inwardly folded end portions and within which are soldered hooking arches 8 in the form of a rounded V which are mounted within the girder with the same separating pitch l as the openings 6 of the hanging members 3, said hooking arches being made for instance from a metal rod. Such an arrangement allows for a maximum angular displacement of the straps (figurated by the dash and dotted lines in FIG. 8) which is of interest when vehicles or the like have a height slightly lower than that of the opening closed by the strap curtain so that they may pass through the curtain.

For mounting the straps 5 in the girder 1 (1') secured to the upper portion of the opening to be closed, it is sufficient to present the passage portion of the openings 6 of the hanging member 3 in registration with the hooking transverse members 20 or 8, slightly raising the hanging member and slightly shifting it laterally towards the left or towards the right and to thus let the strap to fall down to a position where the transverse hooking members 20 abutt the upper closed end of the hook portion 60,60' of the openings 6.

Figure 2:
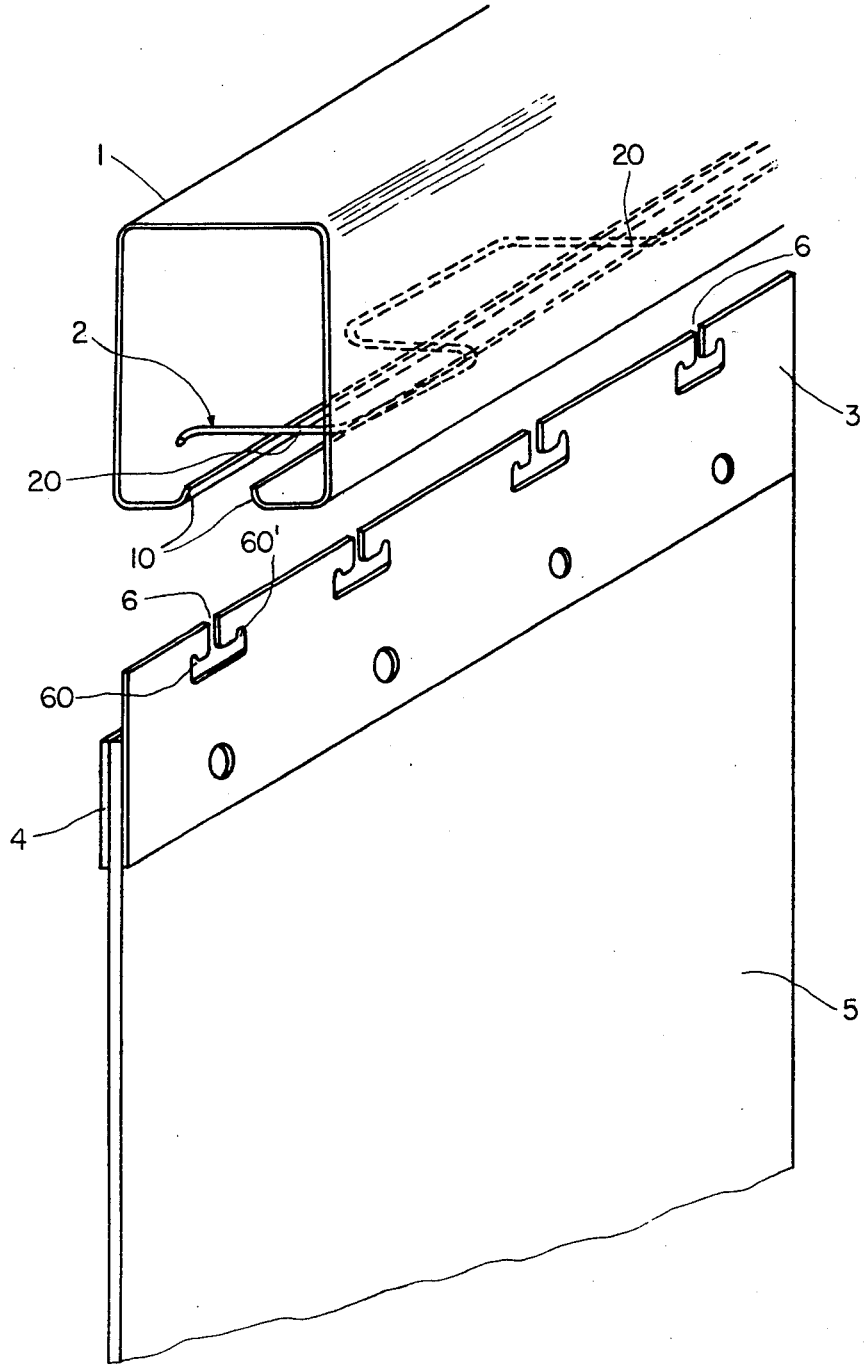
FIG. 2 is a similar exploded perspective view of a second embodiment of the device of the invention.

Since the spacing between the transverse hooking members 20 of the hanging member 2 is equal to the spacing between adjacent openings 6 of the strap hanging members 3, and since the thickness of the plate-like hanging members 3 is lesser than half the spacing between the inwardly folded and flanges 10 of the girder 1, two adjacent straps 5 may be installed side by side or in a different possible overlapping relationship which can be chosen precisely with a system embodying double hooks as illustrated in FIG. 2.

For instance, assuming that the straps and their hanging members 3 have a width of 400 mm, said latter comprising each four openings 6 with the two extreme lateral openings distant of 50 mm (l/2) of the lateral side of the hanging members, the central openings being separated one from the other from the pitch l=100 mm and assuming that an identical spacing or pitch of 100 mm exist between the transversal hooking members 20 of the suspending element 2 or between the V-shaped arches 8, the following possibilities are offered:

1- no overlapping (adjacent straps side by side);
2- an overlapping of 50, 100, 150 or 200 mm (partial overlapping);
3- an overlapping of 400 mm (full overlapping).

Such an arrangement permits to quickly and easily install or remove the straps from the suspending girder and to modify at will the overlapping relationship between adjacent straps for reducing or increasing the sealing of the strap curtain.

While the invention has been described with reference to the embodiments disclosed, it is not confined to the details set forth but is intended to cover such modifications or changes as may come within the scope of the following claims. More particularly, the hanging device according to the invention is also convenient for hooking and suspending rigid straps or strips for building partitioning walls with sheet materials of different kinds.

I claim:

1. A hanging device for hanging straps out of resilient plastic material adapted to be a screen or a curtain for closing apertures, partitioning or insulating premises, which comprises:

an elongated hollow girder in the form of an inverted U opening downwardly, and rigid strap hanging members having lower parts, each of said parts being secured to the upper end of a strap, each hanging member (3) comprising at its upper part, several equidistantly spaced openings (6) each beginning at the upper edge of the hanging member and being prolongated interiorly towards at least a same lateral direction so as to constitute spaced hooks arranged for engagingly cooperating with parallel and equidistant transveral complementary members sustained by the girder (20;8), said complementary members having a thickness lesser than the width of said openings (6) and extending transversally inside said girder (1,1') above the plane of the lower edges of said girder, said transversal complementary members being made of a single piece with a hooking structure introduced within the girder (1), wherein said hooking structure comprises a rod (2) formed with a series of U-shaped alternate folds extending in a same plane, wherein the girder (1) has wings (10), the end portions of which are folded inwardly in the direction one towards each other and further extend slightly upwardly inside the girder while being separated one from each other, the transversal complementary members (2) bearing upon the inner edges of said folded and inwardly extending wings.

2. Hanging device according to claim 1, wherein the openings (6) extend downwardly from the edge of the hanging member (3), then laterally to form an angle or a loop, so as to finally extend back upwardly towards the edge along a reduced distance to define a receiving and stopping hook (60,60') for a complementary member (2), characterized in that each opening (6) is prolongated laterally to form two symmetrical hooks (60,60').

* * * * *